US006831505B2

(12) United States Patent
Ozoe

(10) Patent No.: US 6,831,505 B2
(45) Date of Patent: Dec. 14, 2004

(54) REFERENCE VOLTAGE CIRCUIT

(75) Inventor: Hidetoshi Ozoe, Kanagawa (JP)

(73) Assignee: NEC Corporation, Kanagawa (JP)

( * ) Notice: Subject to any disclaimer, the term of this patent is extended or adjusted under 35 U.S.C. 154(b) by 0 days.

(21) Appl. No.: 10/455,996

(22) Filed: Jun. 6, 2003

(65) Prior Publication Data

US 2003/0227322 A1 Dec. 11, 2003

(30) Foreign Application Priority Data

Jun. 7, 2002 (JP) ..... 2002-167110

(51) Int. Cl.[7] ..... G05F 3/24

(52) U.S. Cl. ..... 327/541; 327/543; 327/539; 323/313; 323/315

(58) Field of Search ..... 327/539, 541, 327/543, 544; 323/312, 313, 314, 315

(56) References Cited

U.S. PATENT DOCUMENTS 6,084,391 A * 7/2000 Onodera ..... 323/315
6,465,997 B2 * 10/2002 Kussener ..... 323/313
6,496,057 B2 * 12/2002 Wada et al. ..... 327/543

FOREIGN PATENT DOCUMENTS

JP 2001-117654 4/2001 ..... G05F/3/26

* cited by examiner

*Primary Examiner*—Timothy A. Callahan
*Assistant Examiner*—Terry L. Englund
(74) *Attorney, Agent, or Firm*—Scully, Scott, Murphy & Presser

(57) ABSTRACT

A reference voltage circuit includes three PMOS transistors and two NMOS transistors. The three PMOS transistors constitute a current mirror circuit and the two NMOS transistors constitute a load circuit. A dummy NMOS transistor is added to the load circuit so as to make three NMOS transistors correspond to the three PMOS transistors and a ratio of currents leaking through PN junctions of diffusion layers on the side of the current mirror circuit is set equal to a ratio of currents leaking through PN junctions of diffusion layers on the side of the load circuit. This allows the reference voltage circuit to output a reference voltage that does not change with temperature even at high temperatures.

11 Claims, 3 Drawing Sheets

REFERENCE VOLTAGE CIRCUIT

BACKGROUND OF THE INVENTION

1. Field of the Invention

The present invention relates to a reference voltage circuit, and particularly to a reference voltage circuit having a CMOS current mirror circuit therein.

2. Description of the Related Art

Conventionally, a reference voltage circuit of this type has been widely adopted within a CMOS semiconductor integrated circuit to produce potentials of different magnitude based on a power supply voltage. The reference voltage circuit being widely adopted includes a CMOS current mirror circuit. That is, the reference voltage circuit is configured to have a PMOS current mirror circuit provided therein and supply bias currents (constant currents) to a load circuit consisting of NMOS transistors, resistors and a diode from the current mirror circuit, in order to output a reference voltage through an output terminal.

FIG. 1 is a circuit diagram illustrating an example of the conventional reference voltage circuit. The conventional reference voltage is a most popular circuit comprising two NMOS transistors N1, N2, a source resistor R2, three PMOS transistors P1, P2, P3, an output resistor R3, and a diode D3.

When assuming a transistor has a channel width W and a channel length L, the current capacity of the MOS transistor is generally related to a ratio of the channel width to the channel length (W/L) of the transistor. The two NMOS transistors N1, N2 are provided such that the NMOS transistor N2 is scaled by a factor of m relative to the NMOS transistor N1. In this case, the scaling factor m is determined by the ratio of the W/L of the NMOS transistor N2 to the W/L of the NMOS transistor N1. Furthermore, the NMOS transistor N1, N2 have drains connected respectively to two nodes 1, 2 and gates commonly connected to the node 1, forming NMOS loads.

The source resistor R2 has one end connected to the source of the NMOS transistor N2. Three PMOS transistors P1, P2, P3 are scaled by a factor of one relative to one another to achieve a 1:1:1 scaling ratio. In addition, the three PMOS transistors have drains connected respectively to the three nodes 1, 2, 3 and gates commonly connected to the node 2, forming a PMOS current mirror.

Moreover, the resistor R3 and the diode D3 are connected in series between the node 3 and the ground, and a reference voltage is output through the node 3.

Subsequently, how the conventional reference voltage circuit operates will be explained. The conventional reference voltage circuit comprises a load circuit consisting of NMOS transistors (hereinafter, each referred to also as an NMOS load), resistors and a diode, and a PMOS current mirror circuit, in which both circuits are connected to each other via the two nodes 1, 2, to form a closed loop. In this case, the PMOS current mirror outputs bias currents scaled by a factor of one relative to each other to the NMOS loads. In the load circuit that has received the bias currents scaled by a factor of one relative to one another, the bias current passing through the source resistor R2 causes the gate-source voltage of the NMOS transistor N2 to become smaller.

The constant current Ic flowing through the NMOS transistor N2 is based on a gate-source voltage of the NMOS transistor N2, which voltage results from the fact that the same amount of current flows through the two NMOS transistors N1, N2, where the NMOS transistor N2 is scaled by a factor of m relative to the NMOS transistor N1. The constant current Ic is determined using the following formula (1) which is known to those skilled in the art.

$$Ic=(1/R2)*(kT/q)*\ln(m) \quad (1)$$

where (kT/q) is determined by the Boltzmann constant k in joules per degree Kelvin, the temperature T in degrees Kelvin (absolute scale) and the magnitude q of the charge of an electron, and is known as the thermal voltage, which is about 26 mV at a temperature of 300K.

The reference voltage Vref to be output from the conventional reference voltage circuit through the node 3 is the sum of the forward voltage, determined by the constant current Ic, of the diode D3 and the voltage across the resistor R3, and is determined using the following formula (2).

$$Vref=Vf+(R3/R2)*(kT/q)*\ln(m) \quad (2)$$

where the first term Vf on the right hand side of equation is the forward voltage of the diode D3 and has a negative temperature coefficient as is known to those skill in the art. When the source resistor R2 and the output resistor R3 are assumed to have the same temperature coefficient, the second term (R3/R2)*(kT/q)*ln(m) on the right hand side of equation is independent of the temperature coefficient of those resistors and has a positive temperature coefficient. Accordingly, when optimally designing the ratio between the magnitudes of the source resistor R2 and the output resistor R3, the temperature coefficients of the first and second terms serve to eliminate each other, allowing the reference voltage Vref to exhibit linear and approximately flat change with temperature.

FIG. 2 is a diagram illustrating how the reference voltage Vref changes with junction temperature Tj in the conventional reference voltage circuit. As shown in FIG. 2, the conventional reference voltage circuit outputs a reference voltage Vref different from a supply voltage and independent of temperature in a specific range of temperatures. The reference voltage circuit outputs a voltage determined with reference to a bandgap voltage reference and therefore, is referred to as a bandgap reference circuit.

Furthermore, when the ratio between the magnitudes of the source resistor R2 and the output resistor R3 is optimally designed, the conventional reference voltage circuit is able to output the reference voltage Vref that linearly changes with temperature in a specific range of temperatures. The gradient, changing with temperature, of the voltage Vref can optionally be determined so as to meet the characteristics of a subsequent circuit.

A CMOS semiconductor integrated circuit has been widely adopted for low power applications and in recent years, increasingly adopted for applications typified such as by an automobile and allowing usage over a wide range of temperatures. Furthermore, since a reference voltage circuit advantageously outputs a reference voltage Vref that exhibits constant and low dependence of voltage on temperature over a wide range of temperatures, the need for a family of products that incorporate therein a reference voltage circuit has been increasing.

However, in the conventional reference voltage circuit, when junction temperature Tj exceeds about 125. degree. C., the magnitude of leakage currents flowing through P-type diffusion layers and N-type diffusion layers within the circuit increases, becoming not negligible relative to the "should-be" magnitude of the bias currents. This causes the ratio of currents flowing through the nodes 1, 2, 3 to be displaced from a 1:1:1 scaling ratio that represents the magnitude of the scaling performed on the W/L of the three PMOS transistors. Furthermore, this causes the aforementioned formulas related to the constant current Ic and the reference voltage Vref to be of no use. That is, as shown in FIG. 2, the dependence of the reference voltage Vref on temperature becomes non-linear, preventing the reference voltage circuit from expanding its availability over a wider range of temperatures.

Moreover, in order to address the above-described problem, for example, the technique disclosed in Japanese Patent Application No. 13(2001)-117654 provides a leakage current removal circuit connected in parallel to a node for outputting a voltage and disposed to remove leakage current from current flowing through the node. However, additionally providing a leakage current removal circuit to a reference voltage circuit increases the scale of the entire circuit and makes the circuit design for expanding circuit availability over a wider range of temperatures become complicated.

SUMMARY OF THE INVENTION

An object of the present invention is to provide a reference voltage circuit having ability to output a reference voltage that linearly changes with temperature over a wider range of temperatures and being usable over a still wider range of temperatures.

The reference voltage circuit of the invention includes: first, second, third MOS transistors being of one conduction type and having drains respectively connected to first, second, third nodes and gates commonly connected to the second node in order to constitute a current mirror circuit; first, second MOS transistors being of the other conduction type and having drains respectively connected to the first and second nodes and gates commonly connected to the first node in order to constitute a load circuit; a source resistor having one end connected to a source of the second MOS transistor of the other conduction type and constituting the load circuit; and an output resistor having one end connected to the third node used to output a reference voltage and constituting the load circuit, in which the reference voltage circuit is further constructed such that a dummy diffusion layer of the other conduction type is connected to at least the third node in order to set a ratio of currents leaking, during operation of the reference voltage circuit, through PN junctions of diffusion layers connected to the first, second, third nodes and being of the other conduction type equal to a ratio of currents leaking, during operation of the reference voltage circuit, through PN junctions of diffusion layers connected to the first, second, third nodes and being of one conduction type.

The above-described reference voltage circuit embodying various aspects of the invention can be described as follows.

That is, the reference voltage circuit according to the first aspect of the invention is constructed such that each of the ratios of currents leaking through PN junctions of diffusion layers is controlled by adjusting a ratio of peripheral lengths of PN junctions of corresponding diffusion layers connected to the first, second, third nodes. Alternatively, the reference voltage circuit is constructed such that each of the ratios of currents leaking through PN junctions of diffusion layers is controlled by adjusting a ratio of areas of PN junctions of corresponding diffusion layers connected to the first, second, third nodes.

The reference voltage circuit according to the second aspect of the invention is constructed such that the dummy diffusion layer of the other conduction type connected to at least the third node constitutes two dummy diffusion layers of two dummy MOS transistors being of the other conduction type and connected to the third and first nodes, and further, the two dummy MOS transistors do not allow bias current to flow therethrough. In this case, each of the peripheral lengths of PN junctions of corresponding diffusion layers is grouped into a channel portion facing a transistor and a non-channel portion other than the channel portion, and a ratio of a channel portion to a non-channel portion of each of diffusion layers being of the other conduction type and connected to the first, second, third nodes is equal to a ratio of a channel portion to a non-channel portion of each of diffusion layers being of one conduction type and connected to the first, second, third nodes.

The reference voltage circuit according to the third aspect of the invention is constructed such that the dummy diffusion layer of the other conduction type connected to at least the third node constitutes two dummy diffusion layers of the other conduction type connected to the third and first nodes and each of the two dummy diffusion layers does not allow bias current to flow therethrough.

The reference voltage circuit according to the fourth aspect of the invention is constructed such that the output resistor and the source resistor are formed as a polysilicon resistor, and the circuit further comprises a diode connected in series to the output resistor.

The reference voltage circuit according to the fifth aspect of the invention is constructed such that the first, second, third MOS transistors of one conduction type are configured to have channel widths scaled by a factor of one relative to one another.

DETAILED DESCRIPTION OF THE PREFERRED EMBODIMENTS

Figure 1:
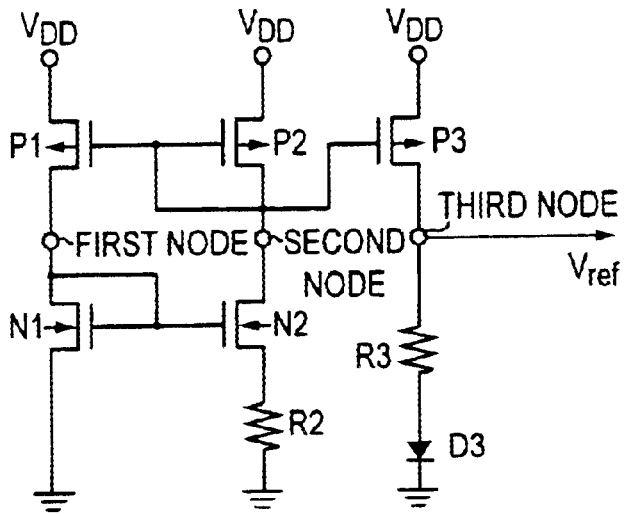
FIG. 1 PRIOR ART
FIG. 1 is an exemplified circuit diagram illustrating the conventional reference voltage circuit.
Figure 3:
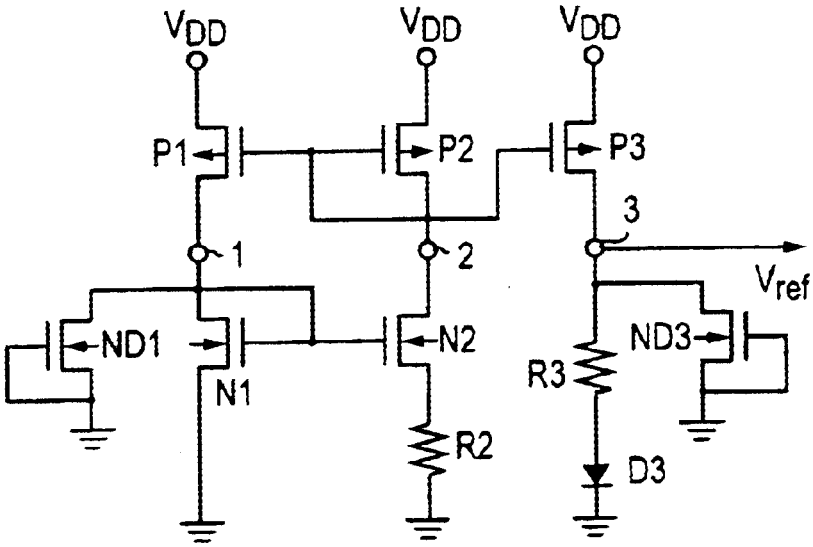
FIG. 3 is a circuit diagram illustrating a reference voltage circuit according to an embodiment of the invention.

An embodiment of the invention will be explained below with reference to the accompanying drawings. FIG. 3 is a circuit diagram illustrating a reference voltage circuit according to the embodiment of the invention. Referring to FIG. 3, the reference voltage circuit of the embodiment comprises two NMOS transistors N1, N2, a source resistor R2, three PMOS transistors P1, P2, P3, an output resistor R3, and a diode D3. The aforementioned configuration of the reference voltage circuit of the embodiment is the same as that of the conventional reference voltage circuit shown in FIG. 1. The difference is that the reference voltage circuit of the embodiment is configured to have two dummy NMOS transistors ND1, ND3 added to the conventional reference voltage circuit.

It should be appreciated that in the reference voltage circuit of the embodiment, the two NMOS transistors N1, N2 are provided such that the NMOS transistor N2 is scaled by a factor of m relative to the NMOS transistor N1. In this case, the scaling factor m is determined by the ratio of the W/L of the NMOS transistor N2 to the W/L of the NMOS transistor N1. Furthermore, the NMOS transistor N1, N2 have drains connected respectively to two nodes 1, 2 and gates commonly connected to the node 1, forming NMOS loads. Furthermore, the source resistor R2 has one end connected to the source of the NMOS transistor N2. Additionally, the three PMOS transistors P1, P2, P3 are scaled by a factor of one relative to one another to achieve a 1:1:1 scaling ratio. In addition, the three PMOS transistors have drains connected respectively to the three nodes 1, 2, 3 and gates commonly connected to the node 2, forming a PMOS current mirror. Moreover, the resistor R3 and the diode D3 are connected in series between the node 3 and the ground, and a reference voltage is output through the node 3. In this case, both the output resistor R3 and the source resistor R2 are formed as a polysilicon resistor. This is because when both the output resistor R3 and the source resistor R2 are formed as a diffusion resistor and reverse and different voltages are applied across the PN junctions of those diffusion resistors, the diffusion resistors will leak current, different from each other, through the corresponding PN junctions.

In the embodiment, the two dummy NMOS transistors ND1, ND3 each have a gate and a source connected together so as not to allow drain current flow therethrough. Furthermore, the NMOS transistors ND1, ND3 is constructed such that leakage current flowing through the PN junction of each of the drain diffusion layers of the NMOS transistors ND1, ND3 changes with voltage and temperature in the same manner as that observed when leakage current flows through the PN junction of the drain diffusion layer of the NNMOS transistor N2, and the NMOS transistors ND1, ND3 have drains connected respectively to the nodes 1, 3. Note that the dummy NMOS transistor ND1 is isolated from the NMOS transistor N1 or formed in the well, in which the NMOS transistor N1 is formed, to have its gate and source provided independent of the gate and source of the NMOS transistor N1.

Furthermore, the two dummy NMOS transistors ND1, ND3 are provided such that N-type diffusion layers connected respectively to the nodes 1, 2, 3 have PN junction peripheral lengths or PN junction areas that are scaled by a factor of one relative to one another in the same manner in which the three PMOS transistors P1, P2, P3 are scaled to achieve a 1:1:1 scaling ratio.

It should be noted that similarly to the scaling ratio of transistors, the scaling ratio of PN junction peripheral lengths or PN junction areas is determined by layout design and is not affected by variations in process employed to manufacture diffusion layers. Furthermore, when it is not possible at a design stage for both the PN junction peripheral lengths and the PN junction areas to be scaled by a factor of one relative to one another to achieve a 1:1:1 scaling ratio which is equivalent to the scaling ratio of the PN junction peripheral lengths or PN junction areas of associated diffusion layers of the three PMOS transistors P1, P2, P3, the PN junction peripheral lengths are designed to achieve a 1:1:1 scaling ratio in preference to the PN junction areas and the PN junction areas are designed to achieve a scaling ratio as close as possible to a 1:1:1 scaling ratio. The reason for it is as follows. That is, in general, doping density at the surface of a field isolation region between component regions is made high to ensure electrical isolation therebetween and as compared to the PN junction at the bottom surface of the N-type diffusion layer, the PN junction at the side surface of an N-type diffusion layer becomes by far the primary governing factor when determining leakage current flowing through the layer and capacitance of the PN junction of the layer. Accordingly, when determining at a design stage the ratio of leakage currents flowing through PN junctions and the ratio of capacitances of PN junctions, the ratio of PN junction peripheral lengths may be determined in preference to the ratio of PN junction areas.

Figure 5:
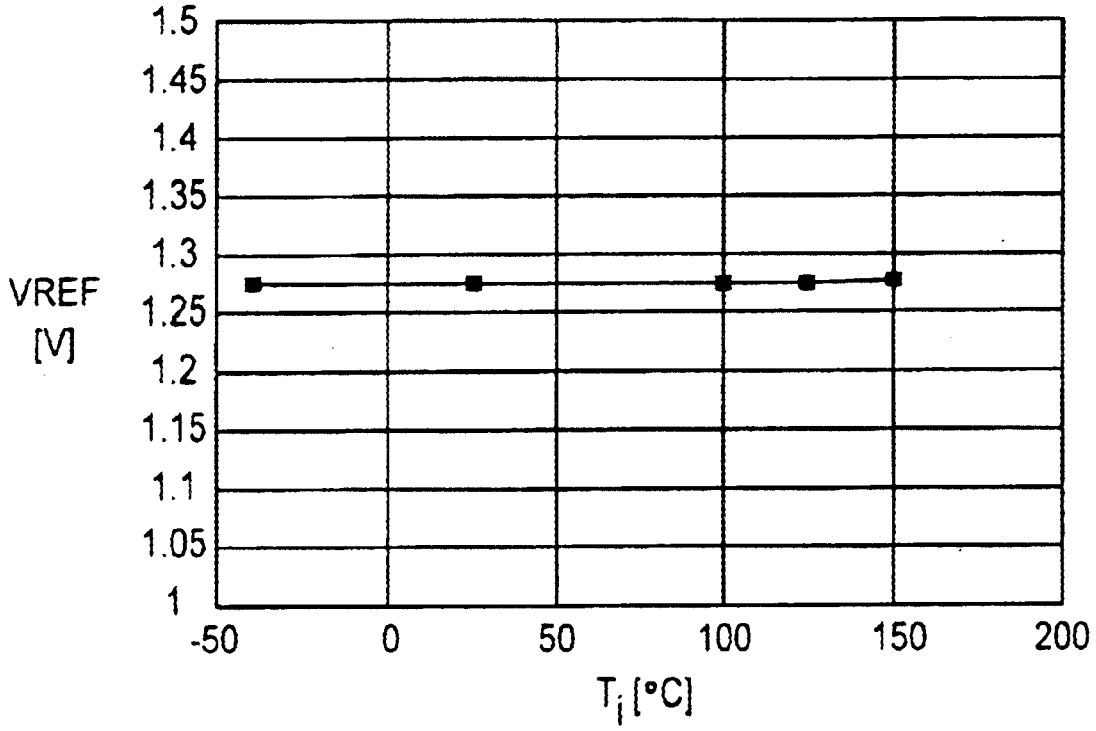
FIG. 5 is a diagram illustrating a graph drawn to show how the reference voltage Vref changes with temperature in the reference voltage circuit shown in FIG. 3.

How the reference voltage circuit of the embodiment operates will be explained. At temperatures ranging from −40. degree. C. to 125. degree. C., leakage current generated through a set of P-type diffusion layers and N-type diffusion layers connected to each of the nodes 1, 2, 3 and flowing through each of the nodes 1, 2, 3 can be ignored relative to the "should-be" bias current flowing through each of the nodes 1, 2, 3. Accordingly, similarly to the conventional reference voltage circuit shown in FIG. 1, the reference voltage circuit of the embodiment can be constructed such that when the ratio between the magnitudes of the source resistor R2 and the output resistor R3 are optimally determined, the temperature coefficients of the first and second terms in the aforementioned formula (2) eliminate each other over a specific range of temperatures. As shown in FIG. 5, the reference voltage circuit of the embodiment outputs a reference voltage Vref that exhibits linear and approximately flat change with temperature and is different from a supply voltage.

On the other hand, when an operating temperature exceeds 125. degree. C., leakage current generated through a set of P-type diffusion layers and N-type diffusion layers connected to each of the nodes 1, 2, 3 and flowing through each of the nodes 1, 2, 3 cannot be ignored relative to the "should-be" bias current flowing through each of the nodes 1, 2, 3. Subsequently, leakage current generated through a set of P-type diffusion layers and N-type diffusion layers connected to each of the nodes 1, 2, 3 will be explained.

The three PMOS transistors P1, P2, P3 connected respectively to the nodes 1, 2, 3 are scaled by a factor of one relative to one another at a design stage to achieve a 1:1:1 scaling ratio and therefore, include the P-type diffusion layers that generally have the same geometric shape.

Accordingly, leakage currents flowing through the associated PN junctions of the PMOS transistors P1, P2, P3 are also scaled by a factor of one relative to one another to achieve a 1:1:1 scaling ratio which is equal to the scaling ratio of the PMOS transistors P1, P2, P3.

The two NMOS transistors N1, N2 connected respectively to the nodes 1, 2 are scaled by a factor of m relative to each other to achieve a 1:m scaling ratio at a design stage and therefore, the N-type drain diffusion layers of the NMOS transistors are also designed to have the similar geometrical shape in order to achieve a 1:m scaling ratio. Accordingly, leakage currents flowing through the associated PN junctions of the NMOS transistors N1, N2 are also scaled by a factor of m relative to each other to achieve a 1:m scaling ratio that is different from the 1:1 scaling ratio related to the PMOS transistors P1, P2. However, the reference voltage circuit of the embodiment has the two dummy NMOS transistors ND1, ND3 connected respectively to the nodes 1, 3 and N-type diffusion layers connected to the three nodes 1, 2, 3 are made to have the PN junction peripheral lengths or PN junction areas that are scaled by a factor of one relative to one another to achieve a 1:1:1 scaling ratio which is equal to the scaling ratio of the three PMOS transistors P1, P2, P3. Accordingly, leakage currents flowing through the nodes 1, 2, 3 to the ground are also scaled by a factor of one relative to one another to achieve a 1:1:1 scaling ratio which is equal to the scaling ratio of the three PMOS transistors P1, P2, P3.

Thus, current flowing between a power supply and each of the three nodes 1, 2, 3 or between each of the three nodes 1, 2, 3 and the ground becomes equal to the total current determined by adding leakage current flowing through each of the three nodes 1, 2, 3 to the corresponding bias current. The total currents flowing through the nodes 1, 2, 3 are scaled by a factor of one relative to one another to achieve a 1:1:1 scaling ratio which is equal to the scaling ratio of the three PMOS transistors P1, P2, P3. Subsequently, referring to FIG. 4, operation of the reference voltage circuit of the embodiment will be explained indicating actual numerical values.

Figure 4:
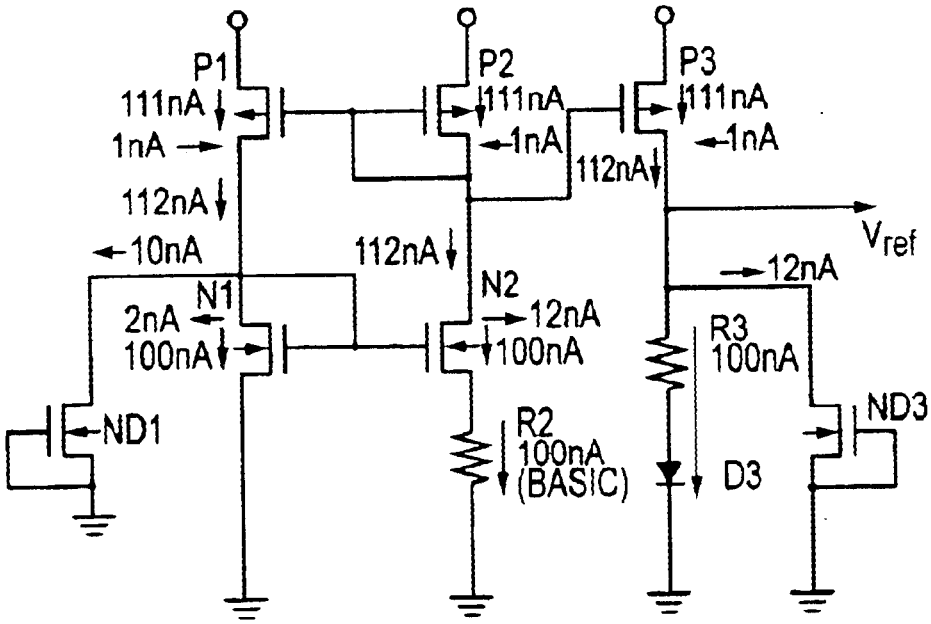
FIG. 4 is a circuit diagram to explain operation of the reference voltage circuit of the embodiment by indicating actual numerical values.

Referring to FIG. 4, assume that a current of 100 nA flows respectively through the transistors N1, N2 and the diode D3 generates a reference voltage. Furthermore, assume that the PMOS transistors P1, P2, P3 are scaled by a factor of one relative to one another to achieve a 1:1:1 scaling ratio and the NMOS transistors N1, N2 are scaled by a factor of m relative to each other to achieve a 1:6 scaling ratio. Moreover, assume that current leaking through each of the PN junctions of the PMOS transistors P1, P2, P3 is 1 nA and current leaking through the PN junction of the NMOS transistor N1 is 2 nA, and current simply calculated based on the 1:6 scaling ratio and leaking through the PN junction of the NMOS transistor N2 is 12 nA. Ideally, since the PMOS transistors P1, P2, P3 are scaled by a factor of one relative to one another to achieve a 1:1:1 scaling ratio, currents flowing through the transistors N1, N2 the resistor R3 and the diode D3 also are scaled by a factor of one relative to one another to achieve a 1:1:1 scaling ratio. However, in actual operation, current leaking through each of PN junctions to a backgate is also taken into account.

A basic assumption throughout the following description is that a current of 100 nA flows through the channel region of the NMOS transistor N2 because the NMOS transistor N2 is connected in series to the PMOS transistor P2. A current of 112 nA flows through the node 2 because a current of 12 nA leaking through the PN junction of the drain of the NMOS transistor N2 has to flow toward the drain of the NMOS transistor N2. A current of 111 nA flows through the PMOS transistor P2 because a current of 1 nA leaking through the PN junction of the PMOS transistor P2 flows toward the node 2. Since the PMOS transistors P1, P2 are scaled by a factor of one relative to each other to achieve a 1:1 scaling ratio, a current of 111 nA flows through the PMOS transistor P1. A current of 112 nA flows through the node 1 because a current of 1 nA leaking through the PN junction of the drain of the PMOS transistor P1 has to flow toward the node 1 from the drain of the PMOS transistor P1. A current of 110 nA would flow through the NMOS transistor N1 because a current of 2 nA leaking through the PN junction of the NMOS transistor N1 has to flow into the drain of the NMOS transistor N1 from the node 1. Accordingly, currents flowing through the NMOS transistors N1, N2 cannot achieve the 1:1 scaling ratio, but resultantly exhibit a 110:100 scaling ratio. To prevent this displacement from the ideal scaling ratio (i. e., 1:1), the dummy NMOS transistor ND1 is made to drain through the node 1 a differential current (i.e., 10 nA) between the NMOS transistors N1, N2 and then a current of 100 nA is made to flow equally through the NMOS transistors N1, N2. This allows the currents flowing through the NMOS transistors N1, N2 to be scaled by a factor of one to each other to achieve a 1:1 scaling ratio.

Likewise, since the PMOS transistors P2, P3 are scaled by a factor of one relative to each other to achieve a 1:1 scaling ratio, a current of 111 nA flows through the PMOS transistor P3. A current of 112 nA flows through the node 3 because a current of 1 nA leaking through the PN junction of the drain of the PMOS transistor P3 flows toward the node 3 from the drain of the PMOS transistor P3. Accordingly, currents flowing through the NMOS transistors N2 and the diode D3 are scaled relative to each other to resultantly exhibit a 100:112 scaling ratio. To prevent this displacement from the ideal scaling ratio (i. e., 1:1), a difference, 12 nA, between the currents flowing through the NMOS transistor N2 and the diode D3 is drained by the dummy NMOS transistor ND3 through the node 3 and then a current of 100 nA is made to flow equally through the NMOS transistor N2 and the diode D3. This allows the currents flowing through the NMOS transistor N2 and the diode D3 to be scaled by a factor of one relative to each other to achieve a 1:1 scaling ratio. Thus, the reference voltage circuit is able to allow the currents flowing through the NMOS transistors N1, N2 and the diode D3 to be scaled by a factor of one relative to one another to achieve a 1:1:1 scaling ratio.

In the aforementioned description, the scaling ratio of the PMOS transistors P1, P2, P3 is assumed to be 1:1:1 and the scaling ratio of the NMOS transistors N1, N2 is assumed to be 1:6, and then, current leaking through the PN junction of the NMOS transistor N2 is simply assumed to be 6 times the current leaking through the PN junction of the NMOS transistor N1. However, in order to calculate current leaking through the PN junction of each of the associated transistors with higher accuracy, it is required to perform operations comprising: grouping a diffusion layer into three components, i.e., a bottom surface component, a channel component, serving as a channel, of a side surface (peripheral region), and a non-channel component, not serving as a channel, of the side surface; calculating leakage current flowing through the PN junction of each of the three components in order to determine the current leaking therethrough; and determining current to be passed through the NMOS transistor ND1 or ND3 based on the calculated leakage current.

When atmospheric temperature exceeds 125. degree. C., the load circuit operates as follows. Upon application of a power supply voltage to a supply rail VDD, the PMOS current mirror circuit formed by the transistors P1, P2, P3 outputs currents scaled by a factor of one relative to one another to the load circuit. In the load circuit receiving the currents scaled by a factor of one relative to one another, the constant (or bias) current Ic flowing through the source resistor R2 causes the gate to source voltage of the NMOS transistor N2 to become smaller. In this case, the ratio of leakage currents flowing through the PMOS current mirror circuit corresponding to the nodes 1, 2, 3 becomes equal to the ratio of leakage currents flowing through the load circuit corresponding to the nodes 1, 2, 3. Accordingly, the aforementioned formulas each representing the constant current Ic and the reference voltage Vref become true. Furthermore, the ratio of peripheral lengths or areas of PN junctions of diffusion layers connected to the individual nodes in the CMOS reference voltage circuit is previously made to be equal to the ratio of MOS transistors of current mirror circuit at a layout design stage in order to prevent the ratio of leakage currents flowing through the nodes from being adversely affected by variations in manufacturing process. This allows the ratio of leakage currents flowing through the PN junctions of the N-type diffusion layers connected to the three nodes 1, 2, 3 to be set with higher accuracy.

Thus, even when currents leak through the PN junctions of diffusion layers connected to the individual nodes, the reference voltage circuit of the embodiment is configured not to allow the ratio of the currents leaking through the individual nodes to be changed. That is, even when leakage current created in a PN junction and flowing through each node increases so that the magnitude of the leakage current cannot be ignored compared to that of the bias current, the reference voltage circuit is able to output a reference voltage Vref that exhibits linear and approximately flat change with temperature. This allows the reference voltage circuit to be used over a wider range of temperatures.

Figure 2:
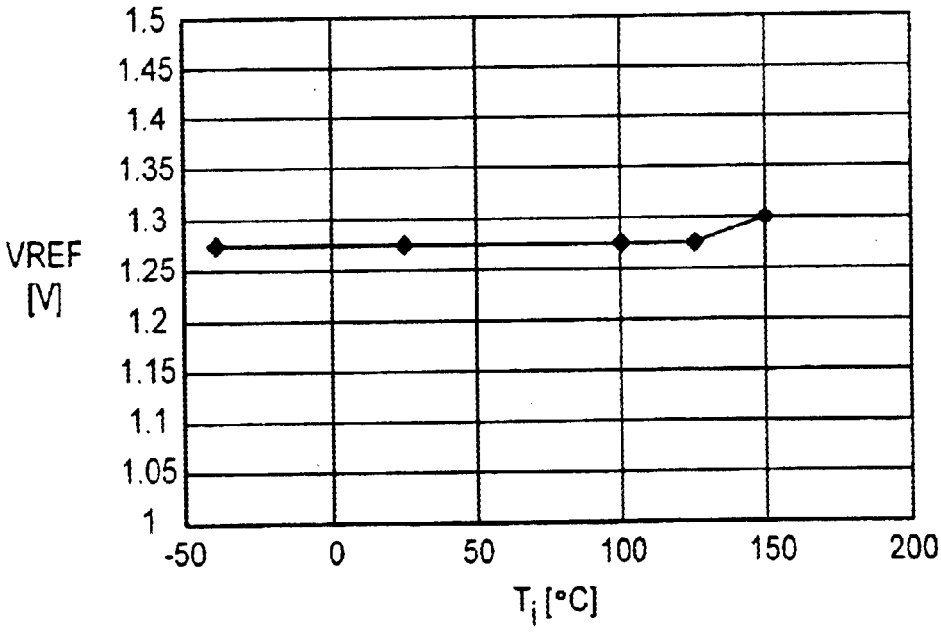
FIG. 2 PRIOR ART
FIG. 2 is a diagram illustrating a graph drawn to show how the reference voltage Vref changes with temperature in the conventional reference voltage circuit shown in FIG. 1.

FIG. 5 is a diagram illustrating how the reference voltage Vref changes with junction temperature Tj in the reference voltage circuit of the embodiment. By comparing graphs illustrated in FIGS. 2 and 5 to each other, it is shown that the reference voltage circuit of the embodiment outputs the reference voltage that exhibits linear and approximately flat change with temperature even over a specific range of temperatures beyond 125. degree. C. Therefore, it can be concluded that the reference voltage circuit of the embodiment is able to supply a reference voltage different from a supply voltage over a wider range of temperatures.

It should be appreciated that the reference voltage circuit of the embodiment is explained as an example comprising: the two dummy NMOS transistors ND1, ND3 respectively connected to the nodes 1, 3; and the N-type diffusion layers respectively connected to the three nodes 1, 2, 3 and configured to allow the ratio of the peripheral lengths or areas of PN junctions of the N-type diffusion layers to be equal to the ratio of the three PMOS transistors P1, P2, P3. Furthermore, the reference voltage circuit of the embodiment is explained as an example configured to allow the ratio of peripheral lengths or areas of PN junctions of a group of NMOS transistors, corresponding to a group of PMOS transistors, to be equal to the ratio of peripheral lengths or areas of PN junctions of the group of PMOS transistors.

Furthermore, although the reference voltage circuit of the embodiment is configured to have the dummy NMOS transistor whose gate is connected to its source, instead, it may be configured to have a dummy NMOS transistor that does not include a source diffusion layer and has its gate connected to its drain. This allows the reference voltage circuit to reduce its size.

Additionally, although the reference voltage circuit of the embodiment is configured to have the two dummy NMOS transistors that do not allow bias current to flow therethrough and are connected to the two nodes 1, 3, instead, it maybe figured to have two dummy N-type diffusion layers that do not allow bias current to flow therethrough and are connected to the two nodes 1, 3. This lowers accuracy with which the ratio of leakage currents flowing through the PN junctions of the N-type diffusion layers connected to the three nodes 1, 2, 3 is set, but allows the reference voltage circuit to reduce its size.

Moreover, although the reference voltage circuit of the embodiment is configured to have the three PMOS transistors scaled by a factor of one relative to one another (i. e., 1:1:1), it may be configured to have the three PMOS transistors arbitrarily scaled relative to one another.

Furthermore, needless to say, the reference voltage circuit of the embodiment may be configured to include the transistors in a CMOS configuration by replacing an NMOS transistor with a PMOS transistor and a PMOS transistor with an NMOS transistor.

As described so far, the reference voltage circuit of the embodiment is configured to have diffusion layers connected to individual nodes and set the scaling ratio of peripheral lengths or areas of PN junctions of the diffusion layers equal to the scaling ratio of MOS transistors of the current mirror circuit. Accordingly, the ratio of peripheral lengths or areas of PN junctions of diffusion layers can previously be set equal to the ratio of MOS transistors of current mirror circuit with high accuracy at a layout design stage in order to prevent the ratio of leakage currents flowing through the nodes from being adversely affected by variations in manufacturing process. This allows the ratio of leakage currents created in PN junctions and flowing through individual nodes not to change even when the reference voltage circuit operates at temperatures higher than the conventional operating temperatures and leakage current generated through diffusion layers connected to each of nodes cannot be ignored relative to bias current. Accordingly, when optimally determining the ratio between the magnitudes of the source resistor and the output resistor, the reference voltage circuit is able to output a reference voltage different from a supply voltage and nearly independent of temperature over a wider range of temperatures.

What is claimed is:

1. A reference voltage circuit comprising:

first, second, and third MOS transistors being of one conduction type and having drains respectively connected to first, second, and third nodes and gates commonly connected to said second node in order to constitute a current mirror circuit;

first, second MOS transistors being of the other conduction type and having drains respectively connected to said first and second nodes and gates commonly connected to said first node in order to constitute apart of a load circuit;

a source resistor having one end connected to a source of said second MOS transistor of the other conduction type and constituting another part of said load circuit; and an output resistor having one end connected to said third node used to output a reference voltage and constituting another part of said load circuit, said reference voltage circuit being further constructed such that a dummy diffusion layer of the other conduction type is connected to at least said third node in order to set a ratio of currents leaking, during operation of said reference voltage circuit, through PN junctions of diffusion layers connected to said first, second, and third nodes and being of the other conduction type equal to a ratio of currents leaking, during said operation of said reference voltage circuit, through PN junctions of diffusion layers connected to said first, second, and third nodes and being of the one conduction type.

2. The reference voltage circuit according to claim 1, wherein each of said ratios of currents leaking through the PN junctions of diffusion layers is controlled by adjusting a ratio of peripheral lengths of the PN junctions of corresponding diffusion layers connected to said first, second, and third nodes.

3. The reference voltage circuit according to claim 1, wherein each of said ratios of currents leaking through the PN junctions of diffusion layers is controlled by adjusting a ratio of areas of the PN junctions of corresponding diffusion layers connected to said first, second, and third nodes.

4. The reference voltage circuit according to claim 1, wherein said dummy diffusion layer of the other conduction type connected to at least said third node constitutes two dummy diffusion layers of two dummy MOS transistors being of the other conduction type and connected to said third and first nodes and wherein said two dummy MOS transistors do not allow bias current to flow therethrough.

5. The reference voltage circuit according to claim 2, wherein each of said peripheral lengths of the PN junctions of corresponding diffusion layers is grouped into a channel portion facing a corresponding transistor and a non-channel portion other than said channel portion, and wherein a ratio of a channel portion to a non-channel portion of each of diffusion layers being of the other conduction type and connected to said first, second, and third nodes is equal to a ratio of a channel portion to a non-channel portion of each of diffusion layers being of the one conduction type and connected to said first, second, and third nodes.

6. The reference voltage circuit according to claim 4, wherein each of said two dummy diffusion layers has its gate connected to its source.

7. The reference voltage circuit according to claim 4, wherein each of said two dummy MOS transistors has its gate connected to its drain.

8. The reference voltage circuit according to claim 1, wherein said dummy diffusion layer of the other conduction type connected to at least said third node constitutes two dummy diffusion layers of the other conduction type connected to said third and first nodes and wherein each of said two dummy diffusion layers does not allow bias current to flow therethrough.

9. The reference voltage circuit according to claim 1, wherein said output resistor and said source resistor are formed as a polysilicon resistor.

10. The reference voltage circuit according to claim 1, further comprising a diode connected in series to said output resistor.

11. The reference voltage circuit according to claim 1, wherein said first, second, and third MOS transistors of the one conduction type are configured to have channel widths scaled by a factor of one relative to one another.

* * * * *